US007857912B2

(12) United States Patent
Randall et al.

(10) Patent No.: US 7,857,912 B2
(45) Date of Patent: Dec. 28, 2010

(54) CONTAINER AND PROCESS FOR CLEANING AND INSPECTING PARTS

(75) Inventors: Fred Randall, Hillside, NJ (US); Robert G. Peterson, Hillside, NJ (US); Al Raven, Hillside, NJ (US)

(73) Assignee: Randall Manufacturing Co., Inc, Hillside, NJ (US)

( * ) Notice: Subject to any disclaimer, the term of this patent is extended or adjusted under 35 U.S.C. 154(b) by 4 days.

(21) Appl. No.: 12/228,569

(22) Filed: Aug. 14, 2008

(65) Prior Publication Data

US 2010/0037918 A1 Feb. 18, 2010

(51) Int. Cl.
*B08B 3/04* (2006.01)

(52) U.S. Cl. ..... 134/25.1; 134/42

(58) Field of Classification Search ..... 134/1, 134/25.1, 25.4, 32, 34
See application file for complete search history.

(56) References Cited

U.S. PATENT DOCUMENTS 2,643,109 A * 6/1953 Wood ..... 267/180
3,311,479 A * 3/1967 Alburger ..... 106/31.57
3,751,970 A * 8/1973 Alburger ..... 356/36
5,299,587 A * 4/1994 Randall et al. ..... 134/111
6,786,339 B2 * 9/2004 Deiss et al. ..... 211/41.8
6,843,260 B2 * 1/2005 Trahan ..... 134/184

* cited by examiner

*Primary Examiner*—Michael Kornakov
*Assistant Examiner*—Ryan Coleman
(74) *Attorney, Agent, or Firm*—Plevy & Keene LLP

(57) ABSTRACT

The present invention is drawn to a wire container comprising a plurality of spring-like wires having wave patterns forming a part support that minimize contact points between the container and one or more contained parts when the container is subjected to a vibration causing the wires and the parts to move, thereby eliminating any fixed contact points between the part and the supporting part support. Another aspect of the current invention is a process for removing penetrant from parts comprising: placing one or more parts with penetrant applied in a container having spring-like wire with wave patterns forming a part support; oscillating the container during a cleaning process thereby compressing and expanding one or more spring-like wires thus exposing part surfaces and removing the penetrant from the parts.

7 Claims, 6 Drawing Sheets

CONTAINER AND PROCESS FOR CLEANING AND INSPECTING PARTS

FIELD OF THE INVENTION

This invention relates generally an article of manufacture and a process for cleaning and inspecting parts exposed to various chemicals during manufacturing.

BACKGROUND OF THE INVENTION

A variety of newly machined metal and plastic parts must be cleaned during the manufacturing process to remove residues of oil, grease, penetrant and other materials. Typically total immersion systems convey parts through a series of cleaning stations that employ cleaning, agitating and spraying to dislodge chemicals and particles.

Parts to be washed are generally placed into containers and oriented based on the greatest number of parts per container dimensions without regard for other important factors such as penetrant removal. In a typical washing process turbulation moves solution over, under, around and through a part. Manifolds with jets or eductors direct a turbulent liquid flow over a working zone.

One of the functions of industrial parts washing is to remove penetrant used in inspection processes. Fluorescent penetrant inspection (FPI) is a widely applied method used to detect casting and forging defects, cracks, and leaks in new products, and fatigue cracks on in-service components surface breaking defects in non-porous materials such as metals, plastics, or ceramics. FPI is based upon fluid penetration into clean and dry surface-breaking discontinuities through capillary action. Penetrant may be applied to the test component by dipping, spraying, or brushing. After adequate penetration time has been allowed, the excess penetrant is removed and a developer is applied. The developer draws penetrant out of the flaw where an indication becomes visible to an inspector under various lighting conditions.

The effectiveness of the inspection depends on the removal of penetrant prior to application of the developer. The penetrant must be thoroughly removed except for that which reveals any defects in the parts. The contact points between the parts and the container are a problem for penetrant removal. Those part areas or points in contact with the container cannot be effectively spray rinsed without overwashing the non-contact surfaces.

SUMMARY OF THE INVENTION

According to an aspect of the present invention a container comprises a plurality of spring-like wires having wave patterns forming a part support that minimize contact points between the container and one or more contained parts when the container is subjected to a vibration causing the wires and the parts to move, thereby eliminating any fixed contact points between a part and the supporting part support.

Another aspect of the invention is a process for removing penetrant from parts comprising: placing one or more parts having a penetrant thereon applied in a container having spring-like wire with wave patterns forming a part support; oscillating the container during a cleaning process thereby compressing and expanding one or more spring-like wires thus exposing part surfaces and removing the penetrant from the parts.

In yet another aspect the invention comprises: a container constructed of stainless steel rods having a wire mesh wave patterns that allow selected parts to flex and reflex in conjunction with an oscillation of the container and a pressured liquid spray on the parts.

BRIEF DESCRIPTION OF THE DRAWINGS

The invention is best understood from the following detailed description when read in connection with the accompanying drawing. The various features of the drawings are not specified exhaustively. On the contrary, the various features may be arbitrarily expanded or reduced for clarity. Included in the drawing are the following figures.

DETAILED DESCRIPTION OF THE INVENTION

Figure 1:
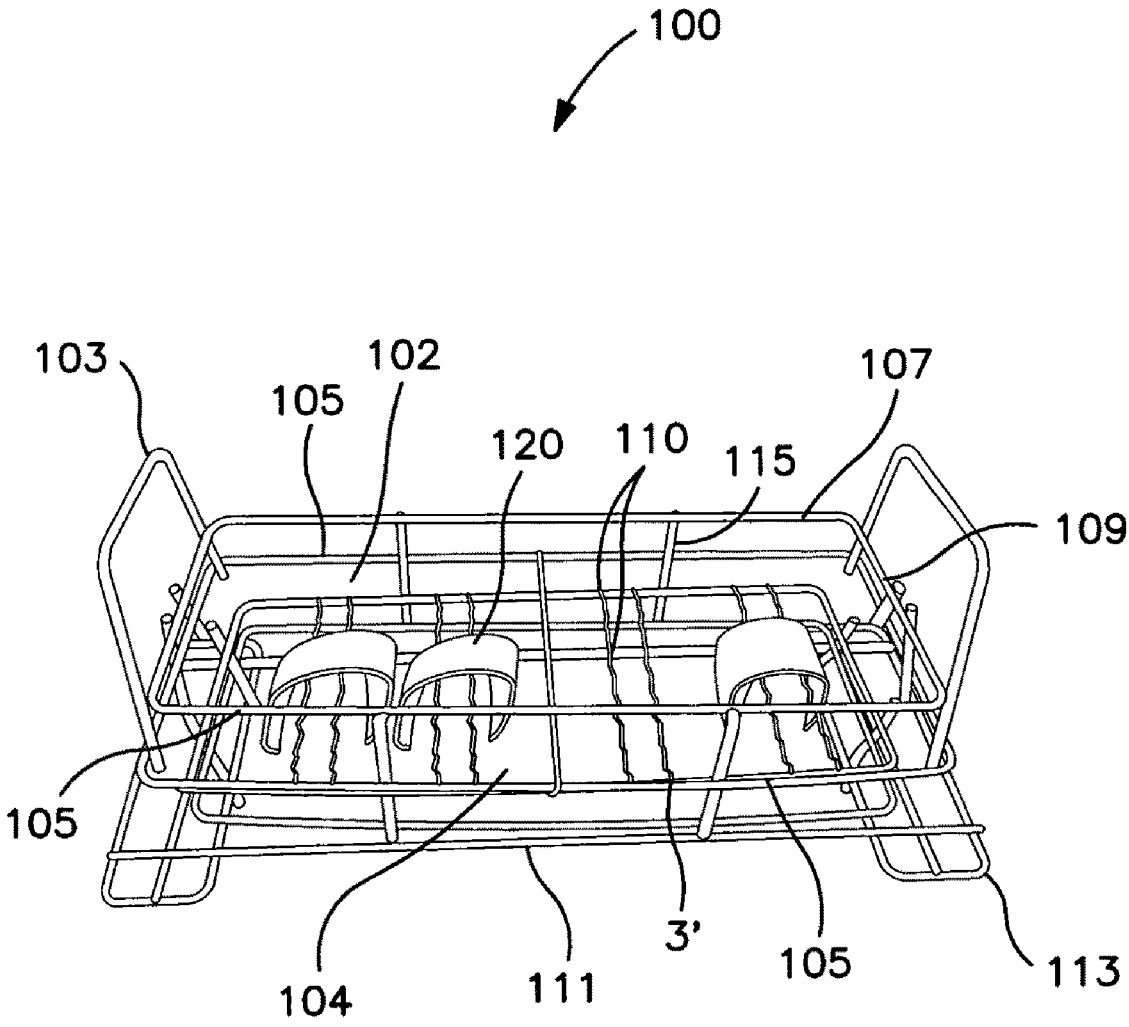
FIG. 1 is a perspective view of a parts washing container or basket in accordance with an embodiment of the present invention.

FIG. 1 is a perspective view of a parts a washing container 100 that provides cleaning utilizing washing, rinsing and drying according to an embodiment of the present invention. The container 100 includes a top portion 102, a bottom portion 104, and spaced-apart side portions 105. The top portion 102, bottom portion 104, and side portions 105 are open for permitting the passage of fluid and debris therethrough. The container 100 has support frame side members 107, 109 and vertical side members 115 that both support and enclose the container. Members 111, 113 provide bottom support. A member 103 provides a means of maneuvering the container 100. A series of spring-like wires 110 in the shape of one or more wave patterns provide a part support for the parts 120 during cleaning. Each end of the spring-like wires 110 are fixed to two opposing ends of the frame side portions 105 at node 3'. In one non-limiting embodiment of the invention the spring-like wires 110 having wave patterns, the top portion 102, bottom portion 104, and spaced-apart side portions 105 are formed from stainless steel.

Figure 2C:
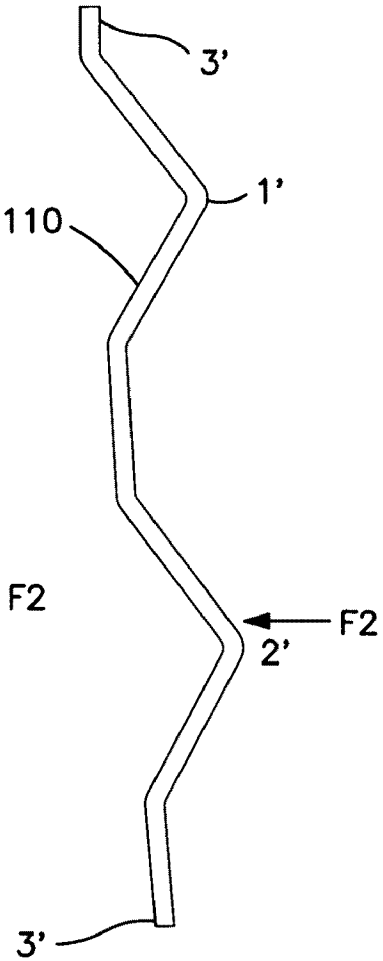
FIG. 2*c* is a perspective view of a spring-like wire having wave patterns in accordance with an embodiment of the present invention.
Figure 2B:
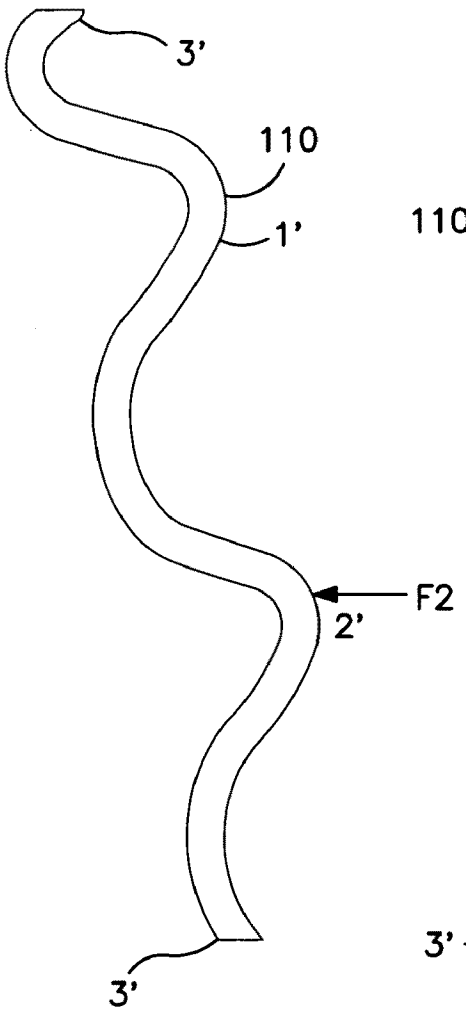
FIG. 2*b* is a perspective view of a spring-like wire having wave patterns in accordance with an embodiment of the present invention.
Figure 2A:
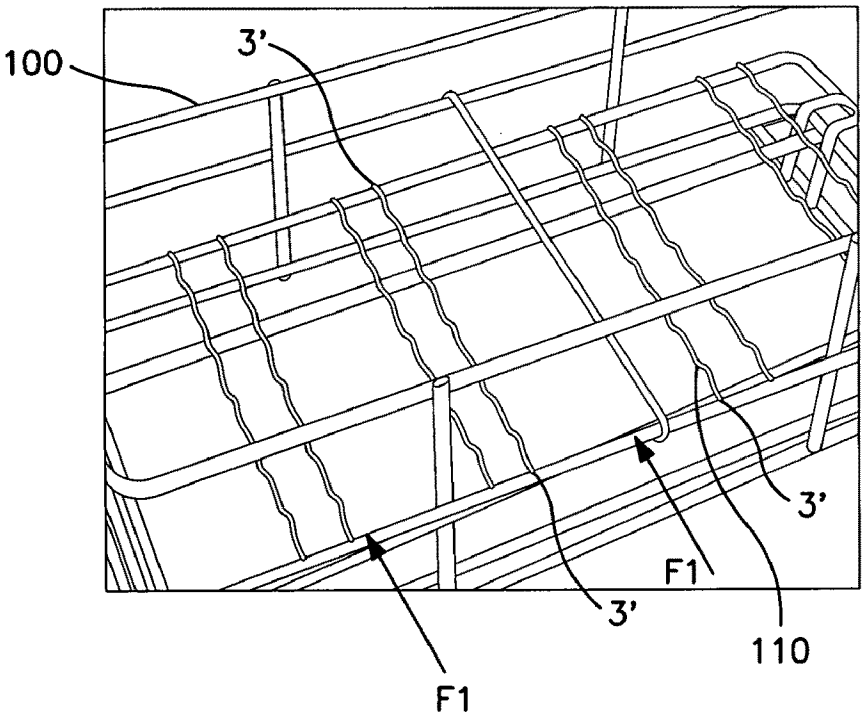
FIG. 2*a* is a perspective view of a parts washing container in accordance with an embodiment of the present invention.

A shown in FIG. 1 contact points between parts 120 and the container 100 pose a problem for removal of chemicals such as penetrant, since sprays and other washing techniques cannot reach the locus of points between the part and the member that supports the part in the container 100. FIG. 2*a*-FIG. 2*c* show an aspect of the present invention where spring-like wires 110 have wire wave patterns that minimize contact points between the container 100 and the parts 120 to be cleaned. By way of example and not limitation, the spring-like wires 110 wave patterns may be generally serpentine, sawtooth or sinusoidal. FIG. 2*b* illustrates a nominally serpentine form. FIG. 2*c* is a view of a spring-like wire having wave patterns nominally in a sawtooth form. The minimal contact at points such as 1', 2' between the wires 110 and the parts 120 offer friction levels insufficient to retain the parts in position when for example a force from a mechanical means or from a liquid spray is applied. Typically the wires 110 move both longitudinally and transversally due to forces F1 transmitted to the wire 110 at node 3' i.e. the connection between the wires 110 and side portion 105; or due to forces F2 applied to the part 120, as by way of example liquid spray sufficiently forceful to move the part 120 from its position at 1', 2'.

Figure 3A:
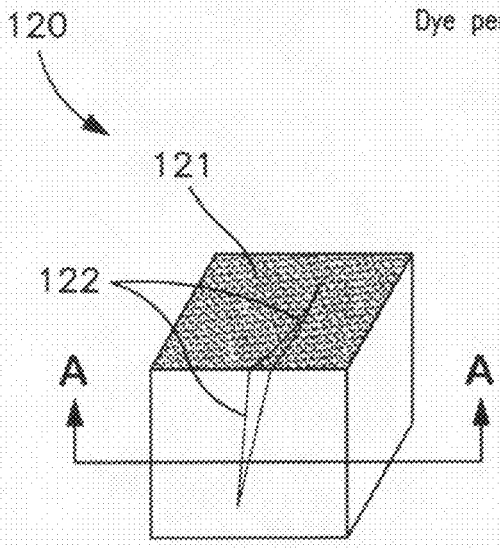
FIG. 3*a-d* is a diagram of a parts penetrant application and inspection cycle in accordance with an embodiment of the present invention.
Figure 3B:
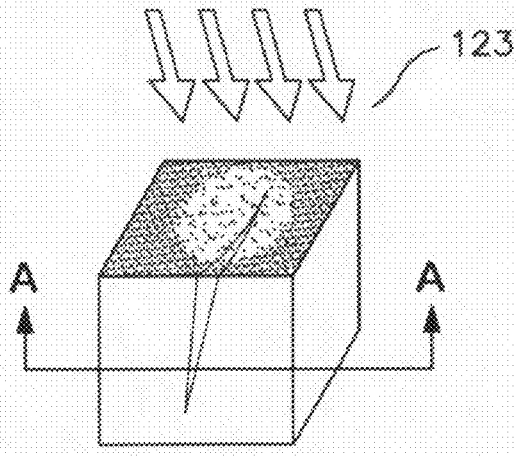
Figure 3C:
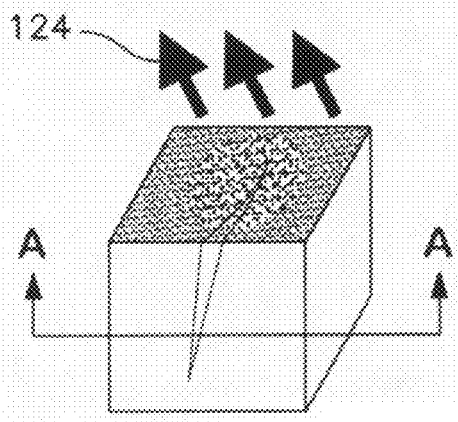
Figure 3D:
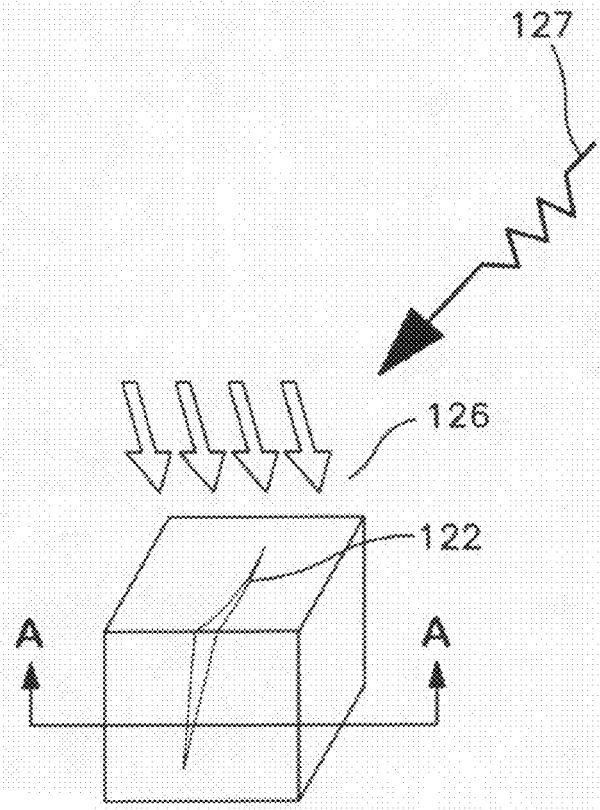

FPI reliability is dependent upon its removal in areas where no defects appear. Therefore a thorough cleaning in every area of a part 120 is essential. The entire surface of a part 120 is cleaned to remove any dirt, paint, oil, grease or any loose scale that could either keep penetrant out of a defect, or cause irrelevant or false indications. The goal of this step is a clean surface where any defects present are open to the surface, dry, and free of contamination. FIG. 3*a*-FIG. 3*d* illustrates a part 120 in cross section A having a defect 122 that does not appear at the surface 121 of the part 120. It is shown in a cross section A to illustrate one manner in which the defect such as a crack may manifest. FIG. 3*b* shows the first step in the inspection process where a penetrant 123 is applied to the part 120. The penetrant may be by way of example a water-washable, solvent-removable, lipophilic post-emulsifiable, or hydrophilic post-emulsifiable. FIG. 3*c* shows that after an adequate penetration time the excess penetrant 124 is removed. In FIG. 3*d* a developer 126 is applied to the part 120. Nominally after a 10 minute development time, the developer 126 draws the penetrant 123 out of the defect 122 where it becomes visible under light 127. A colored stain indicates the position and type of defect on the surface 121. Typically inspection is observed in visible light with intensity in the range of 100 foot-candles for visible dye penetrant. Ultraviolet (UV-A) radiation of 1,000 microwatts per centimeter squared is also a common illumination as is low ambient light levels in the range of less than 2 foot-candles for fluorescent penetrant examinations.

Figure 4B:
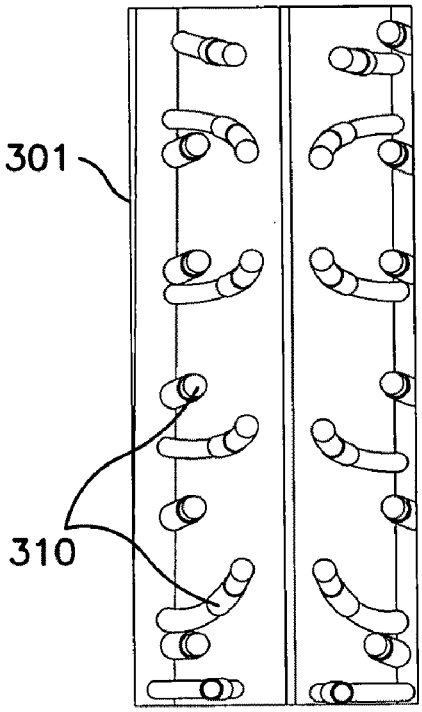
FIG. 4*b* is a top elevation view of a washing system in accordance with the prior art.
Figure 4A:
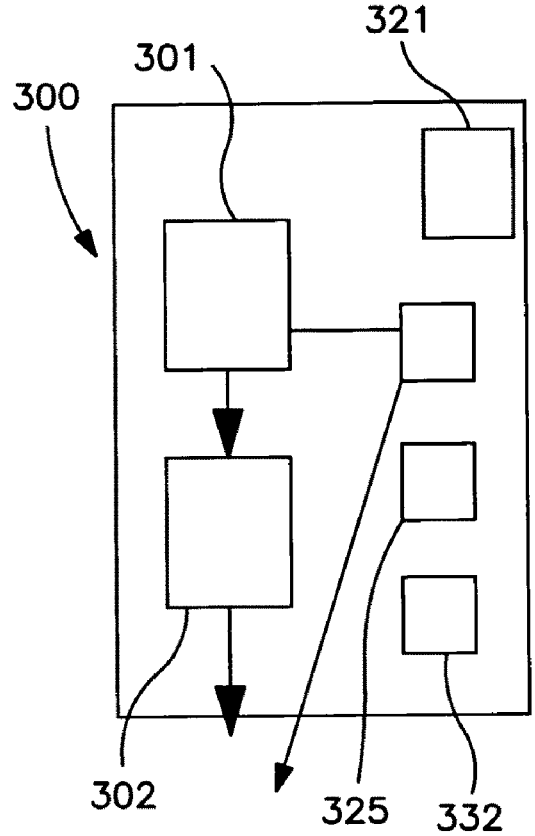
FIG. 4*a* is a block diagram of a parts washing system in accordance an embodiment of the present invention.

Referring now to FIG. 4*a*, the container 100 is loaded into the washing system 300 having penetrant applied and unloaded when the washing cycle is complete and parts 120 are ready for development of the penetrant and the inspection. System 300 includes an immersion tank (not shown) and automatic transport elevators (not shown) as required. The transport elevator tanks place the container 100 into and out of the processing zones such as 301, 302. Using only water or emulsifier as the cleaning agent at low temperatures the parts 120 are thoroughly cleaned but not overwashed. The factors governing this stage are temperature, flow, pressure, spray pattern, time, and container 100 configurations including the spring-like wires 110 part support. Each stage of cleaning is controlled within the system 300 by a programmed controller 321 that provide control signals to the electromechanical devices (not shown) that transport the container 100 and turn on and off processes at the various cleaning zones such as 301, 302. A mixing valve (not shown) may be used to maintain consistent hot water within the limits set by the specifications on penetrant removal. Multiple spray rinsing zones may be incorporated within the processing zones 301, 302. Each zone 301, 302 may have an independent pressure and flow control. Each spray pattern is defined by nozzle types and their locations to provide the required coverage as dictated by the specific parts 120 and container 100 configurations.

Referring to FIG. 4*a* the washing system 300 has means for creating turbulence within at least one of the plurality of wash zones 301, 302. The washing system 300 further includes drying means (not shown) for the parts being discharged from a rinse tank. Additionally the washing system contains means to oscillate or vibrate 325, a plurality of filtering means such as filter 330, including filter pump 332 for recirculating the cleaning solution from zone 301 wash tank through filter 330 and thereafter returning filtered wash solution to a wash tank that would be free from particles of debris.

Container 100 is loaded with parts 120 and placed in the washing system 300 where it is typically gently oscillated during a cleaning process cycle. The oscillation means may be provided by the mechanical vibrator or agitator 325 that provides a force (e.g., through a transducer) to the wire through a connection between the wires and a frame member receiving the applied force. Means to create and transmit such forces are well known to those of ordinary skill in the mechanical arts. The period, frequency and amplitude of the agitator 325 vibrations may be controlled by the programmed controller 321 by providing control signals to electromechanical devices (i.e., transducers) also by means well known to those of ordinary skill in the mechanical arts. The oscillating motion causes the spring-like wires 110 having wave patterns to flex and reflex. This contributative motion causes the parts 120 to slightly move thereby allowing complete washing of penetrate at contact points. Such contact points in the prior art washing systems are not capable of being exposed to the washing medium due to the container design and a static processing mode. The current invention by virtue of the spring-like wires 110 and the oscillation working in combination insures that every part of the part 120 surface is exposed to the washing medium.

Figure 4C:
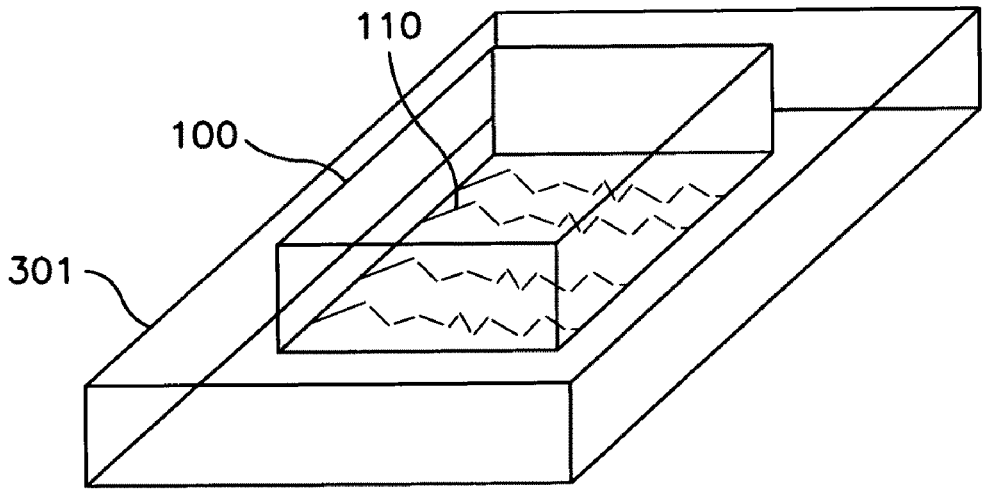
FIG. 4*c* is a perspective view of a washing system and a container in accordance with an embodiment of the present invention.
Figure 5:
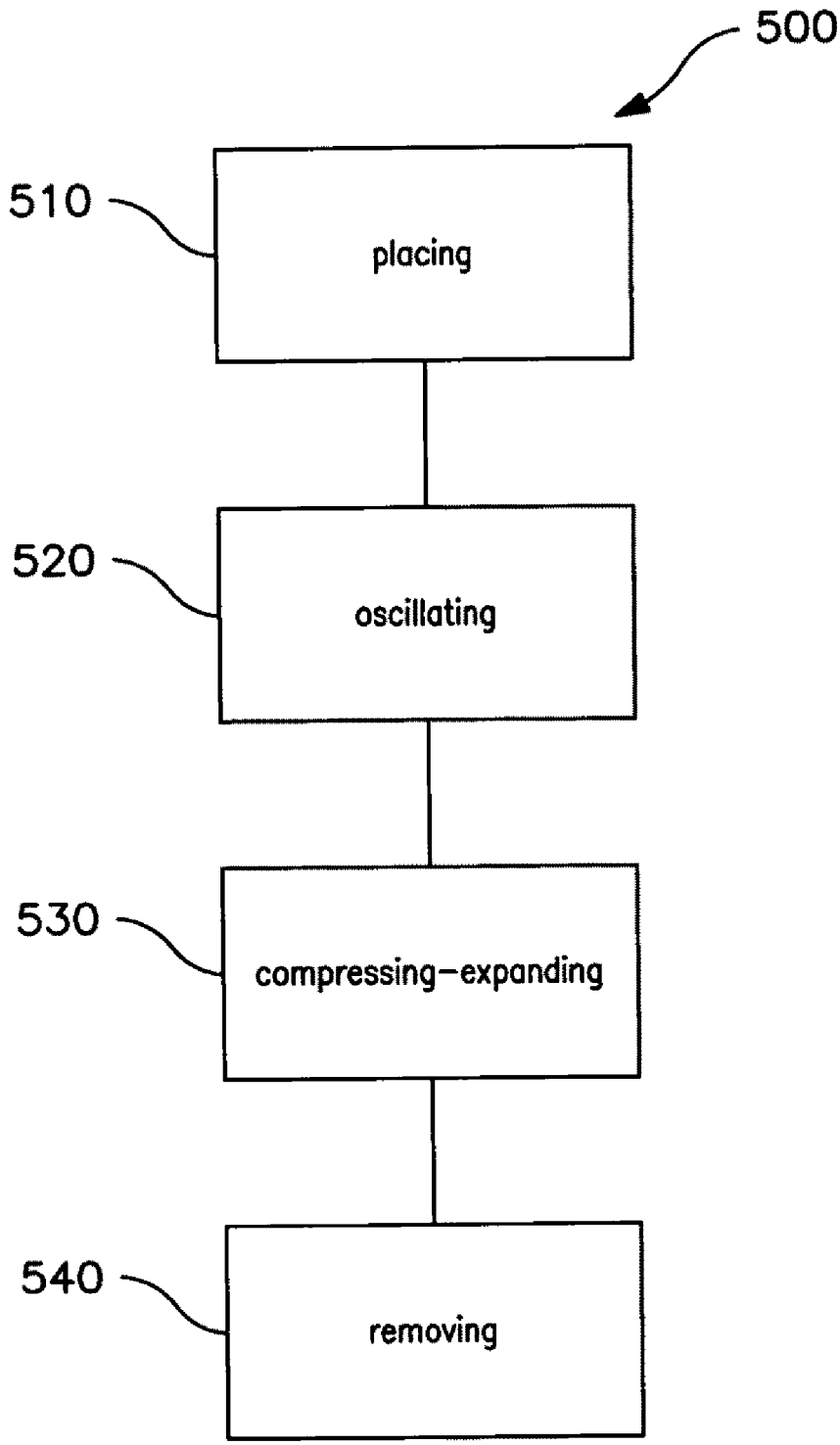
FIG. 5 is a block diagram of a process for washing parts and preparing parts for an inspection in accordance an embodiment of the present invention.

In FIG. 4*c*, the container 100 is shown in the position to receive the spray nozzles 310. The overall configuration of the container 100 is custom made to minimize shadowing during spraying utilizing the spray nozzles 310. The container 100 may remain stationary or move through washing zones 301, 302 relative to washer system 300. Each zone 301,302 is preselected for long or short stroke oscillation during the cycle. The programmed controller executes cycle times to "fire" each zone 301, 302 for a precise exposure time. The zones are fired in sequence and cycled through in multiple "rollovers". By way of example, the water rinse cycle produced may be fast, gentle and accurate to balance the required cleaning variables to remove the penetrant while preventing over washing.

Referring again to FIG. 4*c* when the container is inserted into the washing system 300 it is positioned slightly above the cleaning by spray nozzles 310. In one embodiment, a first step in the cleaning process occurs where the container 100 of parts is subjected to a cleaning spray that contains the spray solution, for a period of between 20 and 30 seconds where one or more spraying nozzles 310 are directed at a 30 to 45 degree angle to pre cleans the parts to remove loose particles of debris.

In one embodiment a V-jet nozzle or a full cone of liquid from a plurality of sides, sprays the parts as the container tray oscillates while above the liquid in front of sprays. Each cycle is pre-selected for stroke length and speed during oscillation. Programmed controlled cycle times are used to "fire" each zone for preset exposure times. This provides constantly changing flow patterns to the process and conserves water consumption.

The invention herein also includes a process 500 for washing parts 120 comprising: placing 510 one or more parts 120 having a penetrant thereon applied in container 100 having spring-like wire with wave patterns forming a part support; oscillating 520 the container 100 during a cleaning process thereby compressing and expanding 530 one or more spring-like wires thus exposing part surfaces and removing 540 the penetrant from the parts.

Referring to FIG. 6 there is shown a spray chamber 600, which chamber 600 accommodates a parts washing container or basket 610. The basket 610 has, as shown, serpentine or wave-like support wires 611 which support a part 612 to be cleaned. As shown, the spray chamber has a plurality of spray jets or nozzles located throughout. As seen in FIG. 6 there are top spray nozzles or jets 606 and 607, middle spray jets 601 and 604 and bottom spray jets 602 and 603.

As will be noted the basket 610 is moveably supported as the part 611 is subjected to multiple spray exposure in a predetermined sequence as will be explained.

Figure 6A:
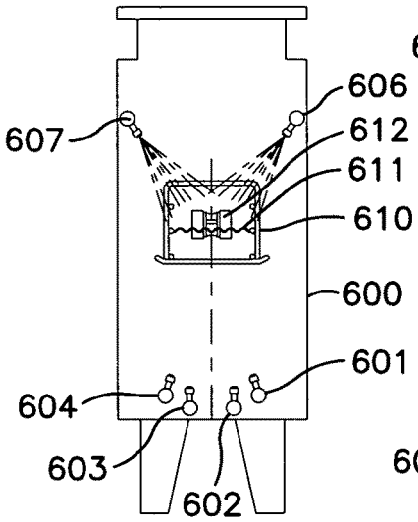
FIG. 6*a* is a front view of a spray chamber spraying parts from top jet sprayers.

Thus FIG. 6*a* shows the basket 610 in a top position in chamber 600 where spray jets 606 and 607 operate to spray or clean the part 612. It is noted while a single part 612 is shown the basket holds multiple parts. While two top spray jets 606 and 607 are shown additional jets or nozzles may be employed.

Figure 6B:
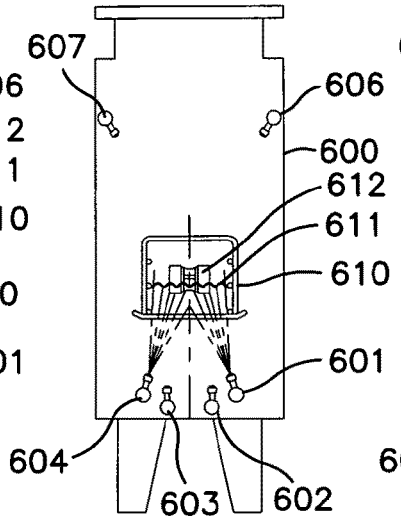
FIG. 6*b* is a front view of the spray chamber spraying parts with middle spray jets.

In FIG. 6*b* the basket 610 is moved to a middle position where jets 601 and 604 are operated to further clean the part.

Figure 6C:
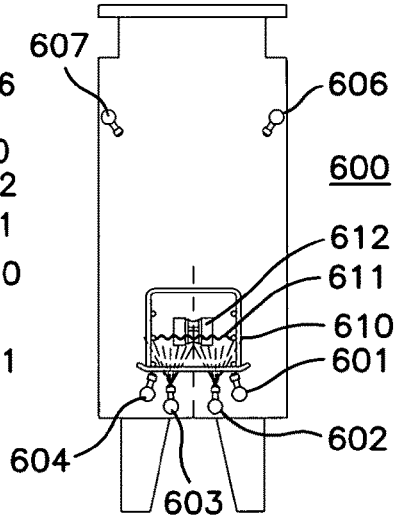
FIG. 6*c* is a front view of the spray chamber spraying parts with bottom spray jets.

In FIG. 6*c* the basket 610 is moved to a lower or bottom position, where jets 602 and 603 are operated.

As can be ascertained the basket 610 is moved by the chamber apparatus and during each position different nozzles or jets are activated.

Figure 7:
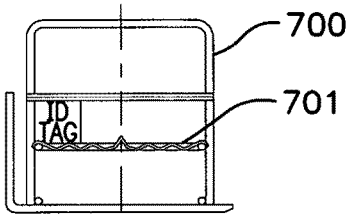
FIG. 7 is a side view of a parts washing container or basket having support wires of another configuration.

FIG. 7 shows an end view of the container or basket 700 having the part support wires 701.

Figure 8:
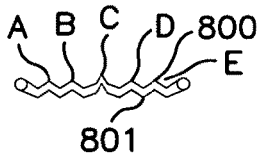
FIG. 8 is a detailed view of top and bottom support wires according to this invention.

FIG. 8 shows the wave-like curvature of the top wire 800 and bottom wire 801 configuration. It is noted that the support wire has multiple peaks. As seen in FIG. 8, there are 5 peaks A, B, C, D, & E. This number of peaks is arbitrary as more or less may be employed.

Figure 9:
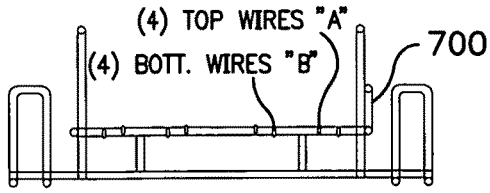
FIG. 9 is a front view of the basket of FIG. 7.

FIG. 9 shows the position of the four top wires A and four bottom wires B on the basket 700 from a front view.

The cleaning operation using the special serpentine or wave shaped support wires aids in the thorough cleaning of parts especially those requiring Fluorescent Penetrant Inspection, such as medical prostheses and so on.

It is understood that the only support for the part 612 are the support wires 611. It has been ascertained that by bending the support wires in a serpentine or wave-like configuration, the part bounces or moves from the support wire contact points 611 to expose the contact areas of the part to the spray stream. The wire supports need not be spring-like as, for example, a guitar string or bed spring but are flexible and therefore can move or oscillate. They of course can be flexible or spring-like as well. In any event it is the function of the support wire to minimize the contact area with the part while allowing separation of the contact for a period sufficient to expose the contact area and therefore to enable cleaning of the same.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is expressly intended that all combinations of those elements that perform substantially the same function in substantially the same way to achieve the same results are within the scope of the invention. Substitutions of elements from one described embodiment to another are also fully intended and contemplated.

We claim:

1. A process for removing penetrant from parts comprising:

placing one or more parts having a penetrant thereon applied in a container comprising a plurality of spring-like wires with wave patterns, one or more of the plurality of spring-like wires forming a part support;

oscillating the container during a cleaning process thereby compressing and expanding the one or more spring-like wires thus exposing part surfaces and removing the penetrant from the one or more parts.

2. The process in claim 1 wherein placing one or more parts includes applying one of a water-washable, solvent-removable, lipophilic post-emulsifiable, or hydrophilic post-emulsifiable penetrant.

3. The process in claim 1 wherein placing one or more parts includes allowing the penetrant time to penetrate the parts.

4. The process in claim 1 wherein placing one or more parts includes removing excess penetrant.

5. The process in claim 1 further including removing one or more parts from the container.

6. The process in claim 5 wherein removing one or more parts includes developing the penetrant where a defect becomes visible.

7. The process in claim 6 wherein a defect becomes visible under ultraviolet light.

* * * * *